United States Patent [19]

Dorsey

[11] 4,289,472

[45] Sep. 15, 1981

[54] PRESS FOR REFRACTORY MATERIAL AND HAVING REMOVABLE CORE MOVING APPARATUS

[75] Inventor: Robert J. Dorsey, Chicago, Ill.

[73] Assignee: Wehr Corporation, Milwaukee, Wis.

[21] Appl. No.: 190,169

[22] Filed: Sep. 23, 1980

Related U.S. Application Data

[63] Continuation of Ser. No. 85,481, Oct. 17, 1979, abandoned.

[51] Int. Cl.[3] ..... B30B 11/02

[52] U.S. Cl. ..... 425/415; 425/416; 425/422; 425/352; 425/412

[58] Field of Search ..... 425/78, 352, 412, 413, 425/414, 415, 416, 419, 422

[56] References Cited

U.S. PATENT DOCUMENTS

| | | | |
|---|---|---|---|
| 1,543,068 | 6/1925 | Eberling | 425/415 X |
| 1,965,758 | 7/1934 | Armstrong | 425/352 |
| 2,254,107 | 8/1941 | Miller et al. | 425/352 X |
| 2,542,874 | 2/1947 | Locartelli | 425/356 |
| 2,723,436 | 11/1955 | Campbell | 425/290 |
| 2,831,212 | 4/1958 | Belden | 425/415 X |
| 2,984,888 | 5/1961 | Collens | 425/352 X |
| 3,127,459 | 3/1964 | Bratton | 425/298 X |
| 3,132,379 | 5/1964 | Crane | 425/415 X |
| 3,154,812 | 11/1964 | Haller | 425/414 X |
| 3,191,232 | 6/1965 | Haller | 425/415 X |
| 3,210,450 | 10/1965 | Bratton | 425/414 X |
| 3,447,205 | 6/1969 | Dorsey | 425/415 X |
| 3,868,201 | 2/1975 | Jacobson et al. | 425/78 |
| 3,972,670 | 8/1976 | Henkel | 425/78 X |

*Primary Examiner*—J. Howard Flint, Jr.

[57] ABSTRACT

A press is disclosed for use in the manufacture of refractory products and particularly including means for causing reciprocal movement of cores into the mold cavity to thereby permit holes to be formed in the compressed refractory product. The core moving apparatus is conveniently attachable and removable from the press to permit removal or replacement of the mold box or to facilitate modification of an existing press to incorporate the means of the invention for causing movement of reciprocal cores. The core supporting structures of the core moving apparatus are also adjustably supported so as to accommodate varied numbers of cores or various arrangements of the cores.

30 Claims, 6 Drawing Figures

PRESS FOR REFRACTORY MATERIAL AND HAVING REMOVABLE CORE MOVING APPARATUS

This application is a continuation of application Ser. No. 085,481, filed Oct. 17, 1979, now abandoned.

FIELD OF THE INVENTION

The present invention relates to presses of the type for use in compressing refractory material as in the manufacture of bricks and other masonry products, and to apparatus for use with such presses and for forming holes in the refractory products.

BACKGROUND PRIOR ART

As explained in the Armstrong U.S. Pat. No. 1,965,758, issued July 10, 1934 and in the Bratton U.S. Pat. No. 3,127,459, issued Oct. 5, 1965, it is frequently desirable that bricks and other similar products formed from compressed refractory material include at least one central bore or aperture. As also stated in those patents, while one method of forming a hole in the bricks is to pour granular refractory material into a press cavity having a stationary internal mandrel or core and then compressing that refractory material, the bricks produced by this process are frequently subject to breakage because it is difficult to successfully compact the granular refractory material around the central mandrel. It is preferred that the refractory material be poured into the mold cavity whereupon the core or mandrel is then forced through the granular refractory material to form the desired bore or indentation. The latter procedure produces refractory products having improved strength and resistance to fracture.

As also explained in U.S. patent application Ser. No. 965,794, filed Dec. 4, 1978 by Dorsey and titled "Press for Compressing Refractory Material and Including a Quick Change Mold Box", and assigned to the assignee of the present invention, and in the Dorsey U.S. Pat. No. 3,447,205, issued June 3, 1969, it is desirable that the brick press be constructed so as to include a mold box which is supported in such manner that it is readily removable from the press to thereby facilitate repair of the mold box or substitution of an alternative mold box to thereby permit manufacture of other types or sizes of bricks. Accordingly, it is desirable that any means provided for forming the desired bores or indentations in the pressed refractory products should not interfere with removal of the mold box.

Attention is also directed to the following prior art patents which illustrate various brick press constructions. See for example U.S. Pat. No. 3,210,450, the Collins U.S. Pat. No. 2,984,888, and the Campbell U.S. Pat. No. 2,723,436. Attention is further directed to the Locatelli U.S. Pat. No. 2,542,874, the Miller et al. U.S. Pat. No. 2,254,107, and the Eberling U.S. Pat. No. 1,543,068.

SUMMARY OF THE INVENTION

The present invention provides a press for use in the manufacture of refractory products and particularly including means for causing reciprocal movement of cores into the mold cavity to thereby permit holes to be formed in the compressed refractory product. The core moving apparatus is conveniently attachable and removable from the press to permit removal or replacement of the mold box or to facilitate modification of an existing press to incorporate the means of the invention for causing movement of reciprocal cores. The core supporting structures of the core moving apparatus are also adjustably supported so as to accommodate varied numbers of cores or various arrangements of the cores.

Figure 1:
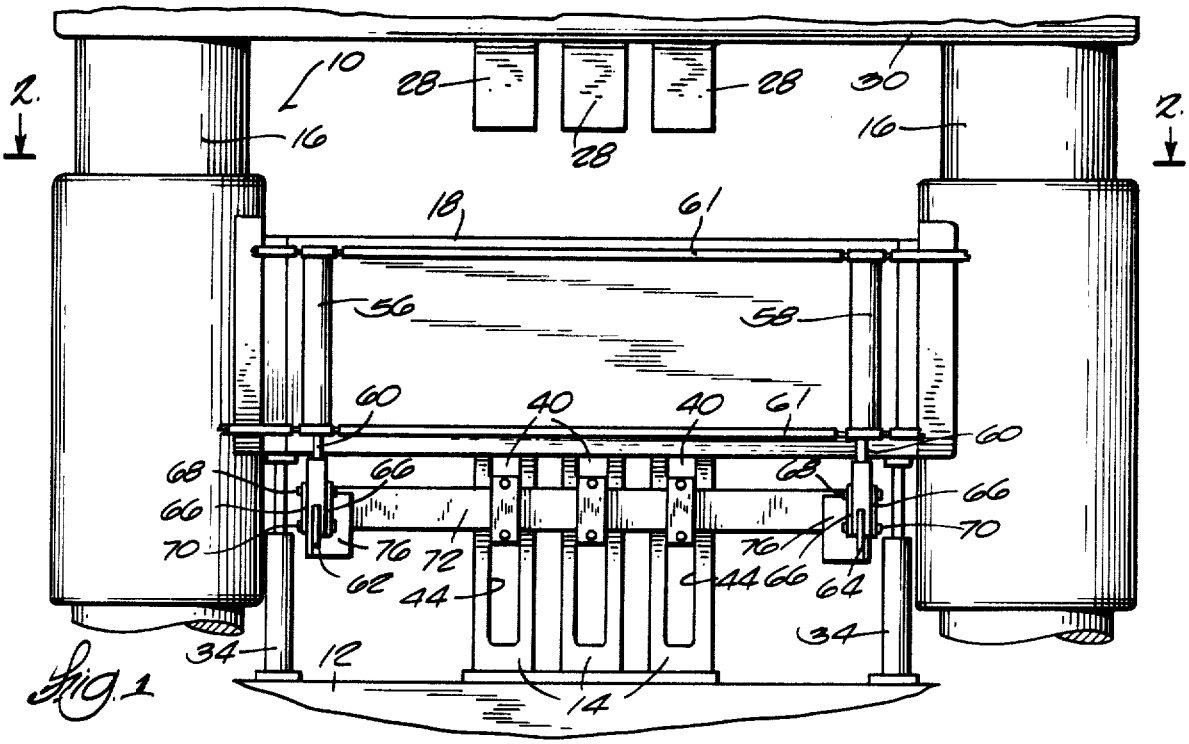
FIG. 1 is a partial elevation view of a refractory press embodying the present invention.

Before describing at least one embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Figure 2:
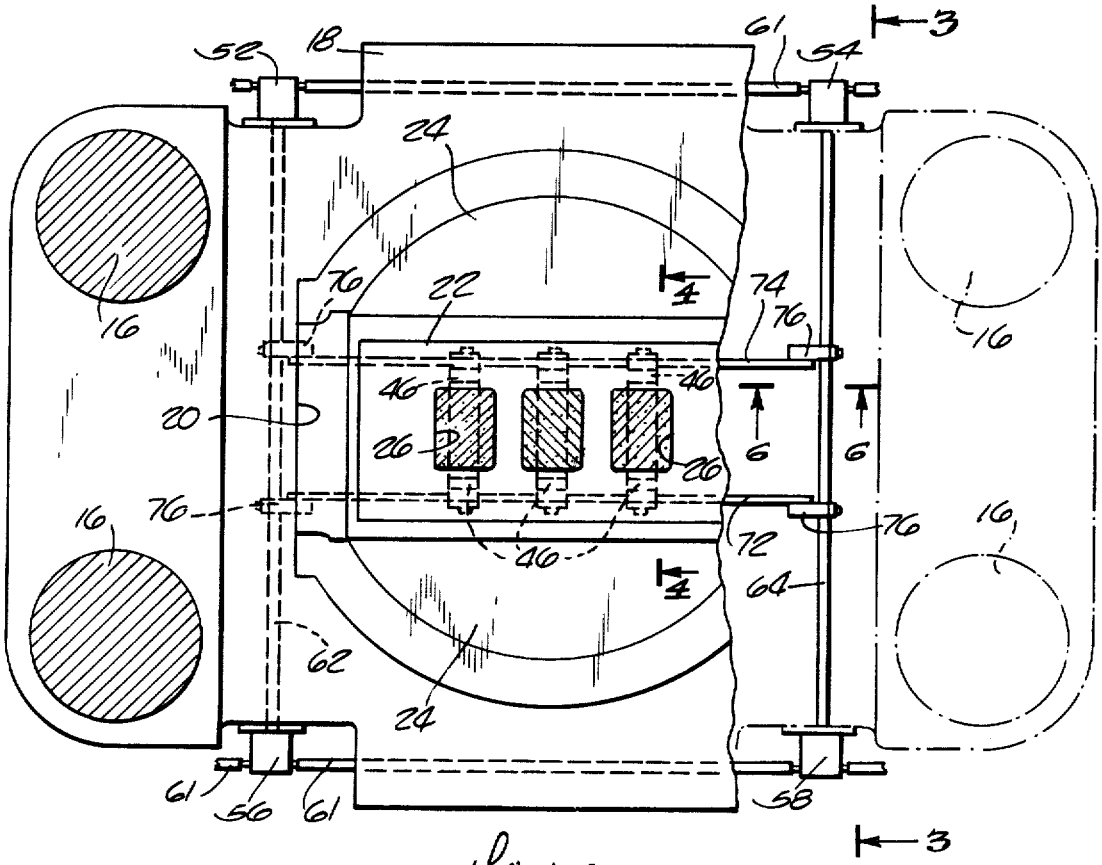
FIG. 2 is a cross section view of the press taken along line 2—2 in FIG. 1.

Illustrated in FIG. 1 is a portion of a press 10 for use in compressing refractory material. While the press 10 can have various constructions, in a preferred embodiment of the invention, the press 10 has a construction as shown in the Dorsey U.S. patent application Ser. No. 965,794, cited above. The general construction and operation of the press 10 is described in greater detail in that application and will be described only briefly herein. The press 10 includes a fixed bed 12 supporting a plurality of upwardly extending plungers 14. The press 10 also includes a plurality of vertical columns 16 slideably supporting a vertically movable mold table 18. The mold table 18 includes a central aperture 20 housing a removable core box or mold box 22, the core box 22 being releaseably retained therein by selectively movable wedges 24. As set forth in the Dorsey U.S. patent application Ser. No. 965,794, the mold table 18 is constructed such that the core box 22 is removable from the mold table 18 by at least partially removing the wedges 24 and by lowering the core box 22 with respect to the mold table. The removable core box 22 (FIG. 2) includes a plurality of generally vertical mold cavities 26 open at their upper and lower ends and intended to receive refractory material to be compressed therein. The refractory material placed in the mold cavities 26 can be pressed between the upwardly extending plungers 16 and complementary downwardly extending plungers 28 (FIGS. 1 and 4), the downwardly extending plungers 28 being supported by a crosshead 30 mounted on the columns 16 for vertical slideable movement and being driven vertically by a suitable conventional ram such as a mechanical ram or a hydraulic ram (not shown).

Means are further provided for causing vertical movement of the mold table 18 to thereby position the mold table 18 with respect to the lower plungers 14.

Such means can comprise hydraulic cylinders 34 causing vertical slideable movement of the mold table 18 on the columns 16.

Figure 4:
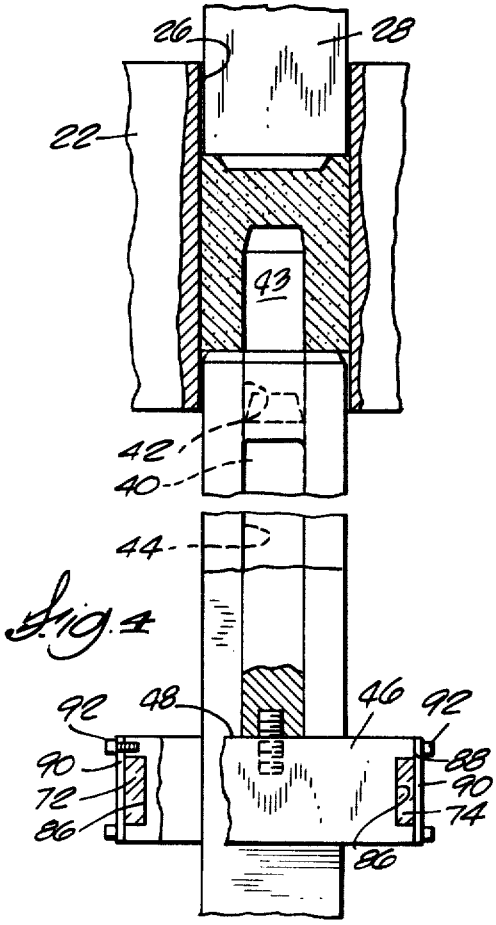
FIG. 4 is an enlarged partial view of the apparatus shown in FIG. 3 and with portions broken away in the interest of clarity.

In operation of the refractory brick press 10 illustrated in the drawings, the mold table 18 can be positioned by the associated hydraulic rams 34 such that the ends of the lower plungers 14 extend into the mold cavities 26 of the core box 22 in the manner shown in FIGS. 1 and 4. Granular refractory material is then placed in the mold cavities 26. Subsequently, the plungers 28 of the upper plunger assembly are forced downwardly by the associated ram into the mold cavities 26 to cause compression of the refractory material therein. Following the compression step, the upper plungers 28 are withdrawn. The pressed refractory products are removed from the mold cavities 26 by then moving the mold table 18 downwardly with the associated hydraulic cylinders 34 such that the plungers 14 of the lower plunger assembly will push the compressed refractory products upwardly out of the mold cavities 26.

Figure 5:
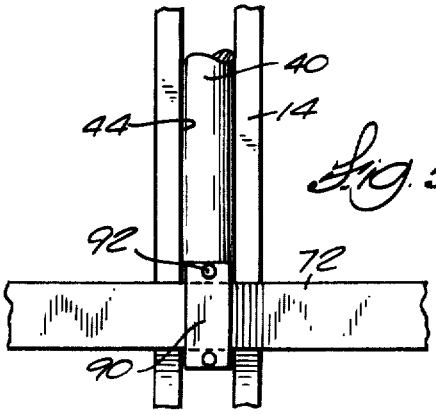
FIG. 5 is an enlarged partial view of the core moving the arrangement shown in FIG. 1.

As best illustrated in FIGS. 1, 4 and 5, the upwardly extending plungers 14 of the lower plunger assembly can be provided with central core rods 40 therein, the core rods 40 being housed within central longitudinally extending bores 42 (FIG. 4) in the plungers 14 for longitudinal slideable telescoping movement therein. More particularly, the core rods 40 are intended to be slideable in the longitudinally extending bores 42 of the plungers 14 between retracted or lower positions shown in FIG. 4 and extended or upper positions wherein the core rods 40 are forced upwardly into the refractory material contained in the mold cavities 26 to thereby form indentations or apertures 43 in the refractory material being compressed as is shown by way of example in FIG. 4.

The plungers 14 also include central longitudinally extending slots 44 in two opposed sides of the plungers 14, the slots 44 communicating with the central longitudinal bore 42 and forming an elongated vertical slot intermediate the upper and lower ends of the plunger and extending transversely through the plungers 14. These slots 44 house core rod bridges 46 which extend through the plungers 14 and which include an upper surface 48 supporting the core rod 40 thereon. The opposite ends of the core rod bridges 46 are adapted to be connected to means for causing vertical reciprocal movement of the core rods 40 with respect to the plungers 14.

While the means for causing vertical reciprocal movement of the core rods 40 can have various constructions, in the illustrated arrangement it includes four hydraulic cylinders 52, 54, 56 and 58 mounted generally on the corners of the mold table 18. One pair 52 and 54 of the hydraulic cylinders are bolted or otherwise removably mounted in mutually spaced relation on one side of the mold table 18 and the other pair of hydraulic cylinders 56 and 58 are similarly mounted on an opposite side of the mold table. The hydraulic cylinders 52, 54, 56, and 58 each include a downwardly extending piston 60. Suitable conventional hydraulic fluid conduits 61 and suitable control means (not shown) are provided to supply hydraulic fluid to the hydraulic cylinders to cause the pistons 60 to be actuated as required. The lower ends of the pistons 60 are adapted to support a pair of generally parallel core rod lift bars 62 and 64, the core rod lift bar 62 being supported at its respective opposite ends by the pistons 60 of the hydraulic cylinders 52 and 56 and the other core rod lift bar 64 being supported at its respective opposite ends by the pistons 60 of the hydraulic cylinders 54 and 58. While the means for causing vertical reciprocal movement of the core rods 40 has been described as comprising hydraulic means, it will be understood by those skilled in the art that pneumatic apparatus could be substituted.

Figure 3:
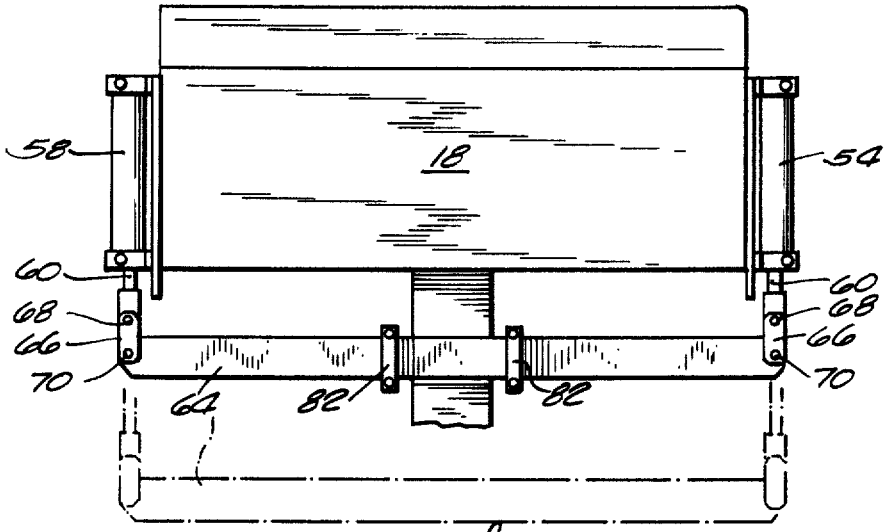
FIG. 3 is a cross section view taken generally along line 3—3 FIG. 2.

As illustrated in FIGS. 1 and 3, the means for attaching the ends of the core rod lift bars 62 and 64 to the pistons 60 can conveniently include a pair of links 66 suspended from the ends of the piston 60 by a pin 68 and by a second pin 70 extending through the lower ends of the links 66 and through an end of the associated core rod lift bar.

The means for providing for vertical movement of the core rods 40 also includes a pair of generally parallel cross bars 72 and 74, each of the cross bars 72 and 74 being supported at its opposite ends by the core rod lift bars 62 and 64, one end of each of the cross bars 72 and 74 being supported at one end by the core rod lift bar 62 intermediate its opposite ends and being supported at the other end by the core rod lift bar 64.

Figure 6:
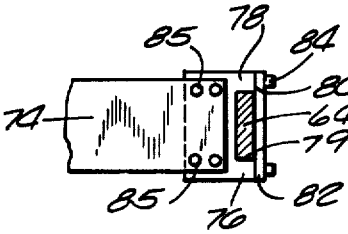
FIG. 6 is a cross section view taken along line 6—6 in FIG. 2.

The means for attaching the ends of the cross bars 72 and 74 to the core rod lift bars 62 and 64 can comprise cross bar mounting brackets 76, the cross bar mounting brackets 76 being slideably mounted on the core rod lift bars 62 and 64 for slideable longitudinal movement thereon. As shown more specifically in FIG. 6, the cross bar mounting brackets 76 each include a rectangular metal block 78 having a rectangular groove or indentation 79 cut in one of its faces 80, the rectangular indentation 79 slideably housing one of the core rod lift bars 62 and 64, that core rod lift bar being secured therein by a face plate 82 fixedly attached to the face 80 of the metal block 78 by screws 84. The opposite ends of the cross bars 72 and 74 are fixedly attached to the cross bar mounting brackets 76 by any suitable means such as screws 85.

The cross bars 72 and 74 are mounted in this manner so as to be positioned in parallel spaced relationship on opposite sides of the plungers 14 of the lower plunger assembly and are adapted to support the opposite ends of each of the core rod bridges 46 therebetween. To provide for attachment of the core rod bridges 46 to the cross bars 72 and 74, the core rod bridges 46 each include a rectangular groove 86 (FIG. 4) in each of their opposite end faces 88, the grooves 86 slideably housing respective cross bars 72 and 74. The cross bars 72 and 74 are held in the groove 86 by retaining plates 90 fixed to the ends of the core rod bridges 46 by screws 92. By loosening the screws 92 restraining the retaining plates 90, the core rod bridges 46 are slideable longitudinally with respect to the cross bars 72 and 74, but when the screws 92 fixedly secure the retaining plates 90 against the ends of the core rods bridges 46, the core rod bridges are precluded from movement with respect to the cross bars 72 and 74.

In refractory presses of the type illustrated in the drawings, it is desirable that the press 10 be useful to manufacture a variety of different types of bricks and bricks having various shapes. Accordingly, such presses are provided with a variety of different lower plunger assemblies, or the plungers 14 of the lower plunger assemblies are shiftable such that the spacing between the individual plungers 14 of the lower plunger assemblies can be varied. As previously stated, it is also desirable that the core box 22 of the press be removable in the manner described in U.S. patent application Ser. No. 965,794, referred to above.

One of the advantages of the present invention is that the core rod lifting apparatus facilitates movement of the core rod bridges 46 longitudinally with respect to the cross bars 72 and 74 so as to accommodate variations in the spacing between the plungers 14 of the lower plunger assembly. The core rod bridges 46 can be moved by loosening the screws 92 fixing the end plates 90 against the end faces 88 of the core rod bridges 46 to thereby permit slideable movement of the core rod bridges 46 along the cross bars 72 and 74 to accommodate variation in the spacings of the plungers 14. Similarly, the cross bars 72 and 74 are movable toward and away from each other to accommodate plungers 14 of various sizes or having various arrangements. The cross bars 72 and 74 can be moved slideably along the lift bars 62 and 64 by loosening the screws 84 securing the cover plates 82 against the mounting brackets 76.

Another of the advantages of the core rod lifting apparatus is that the core rod lift bars 62 and 64 and the cross bars 72 and 74 are readily removable to thereby permit the mold box 22 to be removed from the mold table 18 and a substitute mold box 22 to be inserted. Such removal can be conveniently accomplished by removing the pins 68 or 70 attaching the core rod lift bars 62 and 64 to the hydraulic cylinder pistons 60.

Another of the advantages of the invention is that the core rod lifting apparatus can be readily mounted on an existing refractory material press without substantial modification of that press. Mounting of the apparatus on the press merely requires fixing the hydraulic cylinders to the mold table of the press, adding the required hydraulic fluid supply apparatus, and positioning the various supporting bars beneath the mold table and attaching them to the core rods.

Various features of the invention are set forth in the following claims.

I claim:

1. A press for use in compressing refractory material and comprising a press bed, a mold table, means for supporting the mold table for movement toward and away from the press bed, a mold box supported by the mold table, the mold box including at least one vertically extending mold cavity, means for compressing material placed in the mold cavity, the compressing means including a plunger assembly having at least one plunger supported by the press bed and adapted to be inserted into a portion of the mold cavity, the plunger including a core therein, the core being reciprocally movable with respect to the plunger and into and out of a second portion of the mold cavity when the plunger is received in the mold cavity, and means for causing reciprocal movement of the movable core, said means for causing reciprocal movement of the movable core including a first pair of generally parallel lift bars, means for supporting the lift bars beneath the mold table and for causing vertical reciprocal movement of the lift bars, a pair of generally parallel cross bars positioned transversely to the lift bars, extending therebetween and connected thereto for movement with the pair of lift bars, and means for connecting the core to the cross bars for vertical movement with the cross bars.

2. A press as set forth in claim 1 and wherein the means for connecting the core to the cross bars includes an elongated member having opposite ends, the core being secured to the elongated member intermediate the opposite ends of the elongated member, one of the elongated member opposite ends being supported by one of the cross bars and the other of the elongated member opposite ends being supported by the other of the cross bars.

3. A press as set forth in claim 2 and further including means for attaching the opposite ends of the elongated member to the cross bars for slideable longitudinal movement thereon in the direction of the longitudinal axes of the generally parallel cross bars.

4. A press as set forth in claim 3 and further including means for attaching the cross bars to the parallel lift bars for slideable movement thereon in the direction of the longitudinal axes of the generally parallel lift bars.

5. The press as set forth in claim 1 and further including means for attaching the cross bars to the parallel lift bars for slideable movement thereon in the direction of the longitudinal axes of the generally parallel lift bars.

6. A press for use in compressing refractory material and comprising a press bed, a mold table including opposite sides, means for supporting the mold table for movement toward and away from the press bed, a mold box supported by the mold table, the mold box including at least one vertically extending mold cavity, means for compressing material placed in the mold cavity, the compressing means including a plunger assembly having at least one plunger supported by the press bed and adapted to be inserted into a portion of the mold cavity, the plunger including a core therein, the core being reciprocally movable with respect to the plunger and into and out of a second portion of the mold cavity when the plunger is received in the mold cavity, and means for causing reciprocal movement of the movable core including at least a pair of fluid cylinders, one of the cylinders being mounted on one of the sides of the mold table and the other of the fluid cylinders mounted on the other side of the mold table, the fluid cylinders including downwardly extending vertically movable pistons, and a first bar having opposite ends, one of the opposite ends being supported by one of the pistons and the other of the opposite ends being supported by one of the pistons and the other of the opposite ends being supported by the other of the pistons, and means for attaching the core to the lift bars for vertical movement with the lift bars.

7. A press for use in compressing refractory material and comprising a press bed, a mold table including opposite sides, means for supporting the mold table for movement toward and away from the press bed, a mold box supported by the mold table, the mold box including at least one vertically extending mold cavity, means for compressing material placed in the mold cavity, the compressing means including a plunger assembly having at least one plunger supported by the press bed and adapted to be inserted into a portion of the mold cavity, the plunger including a core therein, the core being reciprocally movable with respect to the plunger and into and out of a second portion of the mold cavity when the plunger is received in the mold cavity, means for causing reciprocal movement of the movable core, including a first pair of fluid cylinders supported by one side of the mold table and a second pair of fluid cylinders supported by the other side of the mold table, each of the fluid cylinders including downwardly extending pistons, a pair of lift bars supported by the pistons for vertical movement with the pistons, one of the lift bars being supported at its opposite ends by a first two of the pistons and the other of the lift bars being supported by a second two of the pistons, a pair of generally parallel cross bars extending between the lift bars, and means for attaching the core to the cross bars for vertical movement with the cross bars.

8. A press as set forth in claim 7 and further including means for attaching the ends of the cross bars to the lift bars for slideable movement.

9. A press as set forth in claim 7 and further including means for removably attaching the lift bars to the pistons.

10. A press as set forth in claim 7 wherein said means for attaching the cores to the cross bars include an elongated member having opposite ends, the core being secured to the elongated member intermediate the opposite ends, one of the member opposite ends being supported by one of the cross bars and the other of the opposite ends being supported by the other cross bar.

11. A press as set forth in claim 10 and further including means for attaching the opposite ends of the elongated member to the cross bars for slideable movement along the cross bars.

12. A press as set forth in claim 11 wherein the elongated member includes grooves in the opposite ends, the grooves housing the cross bars, and means for releasably clamping the cross bars in the grooves.

13. A press as set forth in claim 7 and further including means for releaseably attaching the lift bars to the pistons.

14. A press for use in compressing refractory material and comprising a press bed, a mold table, means for supporting the mold table for movement toward and away from the press bed, a mold box supported by the mold table, the mold box including at least one vertically extending mold cavity, means for compressing material placed in the mold cavity, the compressing means including a plunger assembly having at least one plunger fixedly supported by the press bed and adapted to be inserted into a portion of the mold cavity, the plunger including a core therein, the core being reciprocally movable with respect to the plunger and into and out of a second portion of the mold cavity when the plunger is received in the mold cavity, means for causing reciprocal movement of the movable core, said core moving means including a fluid motor means operably connected to said core, and means for removably attaching said fluid motor means to the mold table.

15. The press set forth in claim 14 wherein the plunger includes an elongated slot therethrough, and wherein the means for causing reciprocable movement of the movable core includes a member extending through the slot and movable longitudinally with respect to the slot, the core being supported by the movable member and said movable member being supported for movement by said fluid motor means.

16. The press set forth in claim 15 and wherein the longitudinally movable member is elongated and has a longitudinal axes extending transversely to the axes of the plunger, the elongated member having opposite ends, and wherein the means for causing reciprocal movement of the movable core includes a first pair of parallel bars, means for causing vertical reciprocal movement of the first pair of parallel bars, a pair of parallel cross bars extending between the first pair of parallel bars and connected thereto for movement with the first pair of parallel bars, one end of the elongated movable member being connected to one of the cross bars and the other end of the elongated member being connected to the other cross bar.

17. The press set forth in claim 16 and further including means for attaching the elongated member to the cross bars for slideable longitudinal movement thereon.

18. The press set forth in claim 16 and further including means for attaching the cross bars to the parallel bars for slideable movement thereon.

19. In a press for use in compressing refractory material and having a press bed, a mold table, means for supporting the mold table for movement toward and away from the press bed, a mold box supported by the mold table, the mold box including at least one vertically extending mold cavity, means for compressing material placed in the mold cavity, the compressing means including a plunger assembly having at least one plunger supported by the press bed and adapted to be inserted into a portion of the mold cavity, the plunger including a core therein, the core being reciprocally movable with respect to the plunger and into and out of a second portion of the mold cavity when the plunger is received in the mold cavity; apparatus for causing reciprocal movement of the movable core comprising a first pair of generally parallel lift bars, means for supporting the lift bars beneath the mold table and for causing vertical reciprocal movement of the lift bars, a pair of generally parallel cross bars extending between the pair of parallel bars and connected thereto for movement with the pair of parallel bars, and means for connecting the core to the cross bars for vertical movement with the cross bars.

20. A press as set forth in claim 19 and wherein the means for connecting the core to the cross bars includes an elongated member having opposite ends, the core being secured to the elongated member intermediate the opposite ends, one of the elongated member opposite ends being supported by one of the cross bars and the other of the elongated member opposite ends being supported by the other of the cross bars.

21. A press as set forth in claim 20 and further including means for attaching the opposite ends of the elongated member to the cross bars for slideable longitudinal movement thereon in the direction of the longitudinal axes of the cross bars.

22. The press as set forth in claim 21 and further including means for attaching the cross bars to the parallel lift bars for slideable movement thereon in the direction of the longitudinal axes of the generally parallel lift bars.

23. The press as set forth in claim 19 and further including means for attaching the cross bars to the parallel lift bars for slideable movement thereon in the direction of the longitudinal axes of the generally parallel lift bars.

24. The apparatus set forth in claim 19 wherein said means for supporting said lift bars and for causing reciprocal movement of the lift bars includes a first pair of fluid cylinders supported by one side of the mold table and a second pair of fluid cylinders supported by the other side of the mold table, each of the fluid cylinders including downwardly extending pistons, one of the lift bars being supported at its opposite ends by a first two of the pistons and the other of the lift bars being supported by a second two of the pistons, a pair of generally parallel cross bars extending transversely to the lift bars and supported by the lift bars therebetween, and means for attaching the core to the cross bars for vertical movement with the cross bars.

25. A press as set forth in claim 24 and further including means for attaching the ends of the cross bars to the lift bars for slideable movement.

26. A press as set forth in claim 24 and further including means for removably attaching the lift bars to the pistons.

27. A press as set forth in claim 24 wherein said means for attaching the cores to the cross bars include an elongated member having opposite ends, the core being secured to the elongated member intermediate the opposite ends, one of the member opposite ends being supported by one of the cross bars and the other of the opposite ends being supported by the other cross bar.

28. A press as set forth in claim 27 and further including means for attaching the opposite ends of the elongated member to the cross bars for slideable movement along the cross bars.

29. A press as set forth in claim 28 wherein the elongated member includes grooves in the opposite ends, the grooves housing the cross bars, and means for releaseably clamping the cross bars in the grooves.

30. A press as set forth in claim 24 and further including means for releaseably attaching the lift bars to the pistons.

* * * * *